US005452815A

United States Patent [19]

Hsiung

[11] Patent Number: 5,452,815

[45] **Date of Patent: * Sep. 26, 1995**

[54] BASE CONFIGURATION FOR BIAXIAL STRETCHED BLOW MOLDED PET CONTAINERS

[75] Inventor: Shieh M. Hsiung, Hsin-Chu, Taiwan, Prov. of China

[73] Assignee: Yuan Fang Limited, Taipei City, Taiwan, Prov. of China

[ * ] Notice: The portion of the term of this patent subsequent to Jun. 14, 2011 has been disclaimed.

[21] Appl. No.: 160,802

[22] Filed: Dec. 3, 1993

Related U.S. Application Data

[63] Continuation-in-part of Ser. No. 894,905, Jun. 8, 1992, Pat. No.5,320,230.

[51] Int. Cl.[6] ..... B65D 1/02; B65D 1/42; B65D 23/00

[52] U.S. Cl. ..... 215/400; 220/606; 220/608; 220/609

[58] Field of Search ..... 215/1 C; 220/606, 220/608, 609

[56] References Cited

U.S. PATENT DOCUMENTS

| | | | |
|---|---|---|---|
| 3,727,783 | 4/1973 | Carmichael | 215/1 C |
| 3,935,955 | 2/1976 | Das | 220/606 X |
| 4,134,510 | 1/1979 | Chang | 220/606 X |
| 4,249,667 | 2/1981 | Pocock et al. | 220/606 X |
| 4,254,882 | 3/1981 | Yoshino | 220/606 X |
| 4,294,366 | 10/1981 | Chang | 220/606 X |
| 4,318,489 | 3/1982 | Snyder et al. | 220/606 X |
| 4,335,821 | 6/1982 | Collette et al. | 220/606 X |
| 4,355,728 | 10/1982 | Yoshino et al. | 215/1 C |
| 4,785,949 | 11/1988 | Krishnakumar et al. | 215/1 C |
| 4,865,206 | 9/1989 | Behm et al. | 220/606 X |
| 4,892,205 | 1/1990 | Powers et al. | 215/1 C |
| 4,978,015 | 12/1990 | Walker | 220/606 X |
| 4,997,692 | 3/1991 | Yoshino | 215/1 C X |
| 5,024,340 | 6/1991 | Alberghini et al. | 215/1 C |
| 5,064,080 | 11/1991 | Young et al. | 215/1 C |
| 5,072,841 | 12/1991 | Okhai | 215/1 C |
| 5,320,230 | 6/1994 | Hsiung | 220/606 X |

FOREIGN PATENT DOCUMENTS

| | | | |
|---|---|---|---|
| 385693 | 9/1990 | European Pat. Off. | 215/1 C |
| 3275431 | 12/1991 | Japan | 215/1 C |
| 444943 | 2/1992 | Japan | 215/1 C |
| 2067160 | 7/1981 | United Kingdom | 215/1 C |
| 8605462 | 9/1976 | WIPO | 220/606 |

*Primary Examiner*—Sue A. Weaver

*Attorney, Agent, or Firm*—Morton J. Rosenberg; David I. Klein

[57] ABSTRACT

A base configuration for use with biaxially stretched blow molded PET containers is provided. In particular, the base includes a concave spherical portion disposed at a central position on the base. A first protruding circular member is formed around the circumference of the concave spherical portion. An annular groove is disposed around the first protruding circular member. A second protruding circular member is formed around the circumference of the annular groove. Five legs extend radially outward from the second protruding circular member. The outer surface of each leg subtends an angle of 72 degrees, and a curved rib is formed between every pair of legs, the ribs having an umbrella bone structure and each of the ribs subtending an angle of 0 degree, whereby the base of the container has an increased internal pressure resistance and thus prevents cracking in the base.

3 Claims, 6 Drawing Sheets

BASE CONFIGURATION FOR BIAXIAL STRETCHED BLOW MOLDED PET CONTAINERS

CROSS-REFERENCE TO RELATED APPLICATION

This Application is a continuation-in-part of application Ser. No. 07,894,905, filed Jun. 8, 1992 entitled A Base Configuration for a Biaxial Stretched Blow Molded PET Container, now U.S. Pat. No. 5,320,230.

BACKGROUND OF THE INVENTION

There are a variety of base configurations for biaxially stretched blow molded PET containers on the market. These include configurations, for example described in U.S. Pat. No. 4,785,949 and U.K. Patent Application No. 2067160. The former (see FIGS. 5 and 6) comprises a central convex portion and five radiating legs, and is characterized in that the legs and feet are generally of the same outline as the ribs and legs of a base configuration having six legs and feet, thereby rendering the ribs between the feet greater width. The latter (see FIGS. 7 and 8) disclose a base configuration with a concave central portion formed therein, the periphery of the concave central portion intersecting a lower end of an inclined rim. However, stress cracks or even rupture is initiated in such base configurations when the applied pressure exceeds a certain critical level.

Therefore it is an object of the present invention to provide a base configuration for biaxially stretched blow molded PET containers which may obviate and mitigate the above-mentioned drawbacks.

SUMMARY OF THE INVENTION

This invention relates to an improved base configuration for biaxially stretched blow molded PET containers.

It is the primary object of the present invention to provide a base configuration for biaxially stretched blow molded PET containers which has a high internal pressure resistance.

It is another object of the present invention to provide a base configuration for biaxially stretched blow molded PET containers which possesses a high drop impact resistance.

It is still another object of the present invention to provide a base configuration for biaxially stretched blow molded PET containers which has good standing stability.

It is still another object of the present invention to provide a base configuration for biaxially stretched blow molded PET containers which is of high blow moldability and strength to resist cracking.

It is a further object of the present invention to provide a base configuration for biaxially stretched blow molded PET containers which has a larger volume than it would otherwise have.

The invention accordingly consists of features of constructions and methods, combination of elements, arrangement of parts and steps of the method which will be exemplified in the constructions and method hereinafter disclosed, the scope of the application of which will be indicated in the claims which follow.

DETAILED DESCRIPTION OF THE PREFERRED EMBODIMENT

Figure 1:
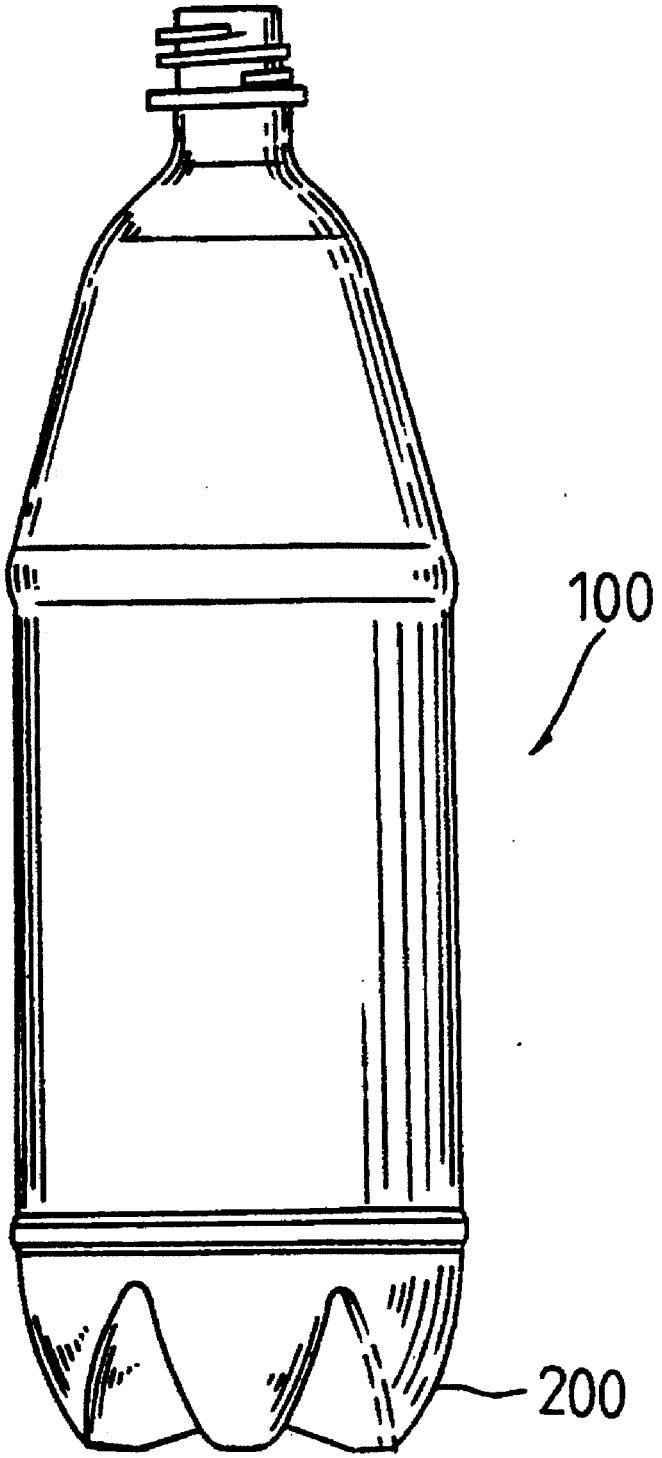
FIG. 1 is a front view of the present invention.

For purposes of promoting the understanding of the principles of the instant invention, reference will now be made to the embodiment illustrated in the drawings. Specific language will be used to describe same. It will, nevertheless, be understood that no limitation of the scope of the invention is thereby intended, such alterations and further modifications of the illustrated device, and such further applications of the principles of the invention as illustrated herein, as would normally occur to one skilled in the art to which the invention relates, being contemplated as being within the scope of the invention.

With reference to the drawings and in particular to FIG. 1 thereof, the numeral 100 denotes a plastic container which is characterized in the base configuration 200. The container 100 is made of PET (polyethylene telephthalate), such as PET material, which is biaxially stretched blow molded from a preform.

Figure 2A:
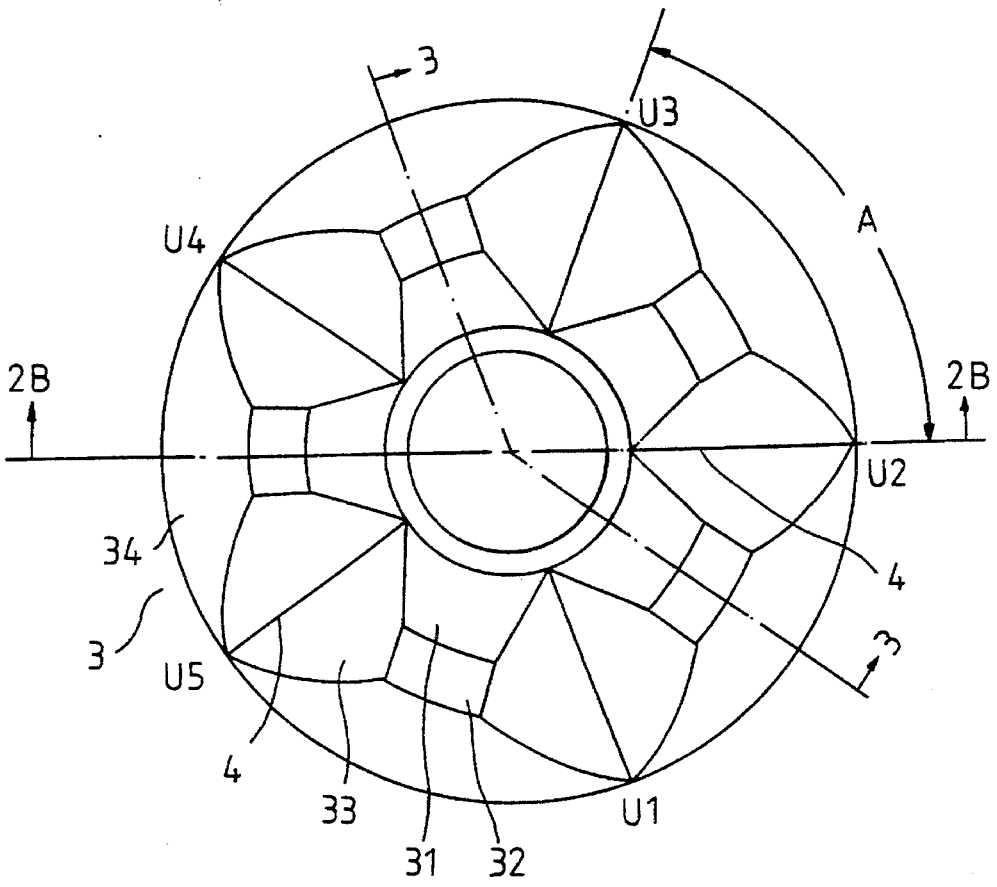
FIG. 2A is a bottom view of the present invention.
Figure 2B:
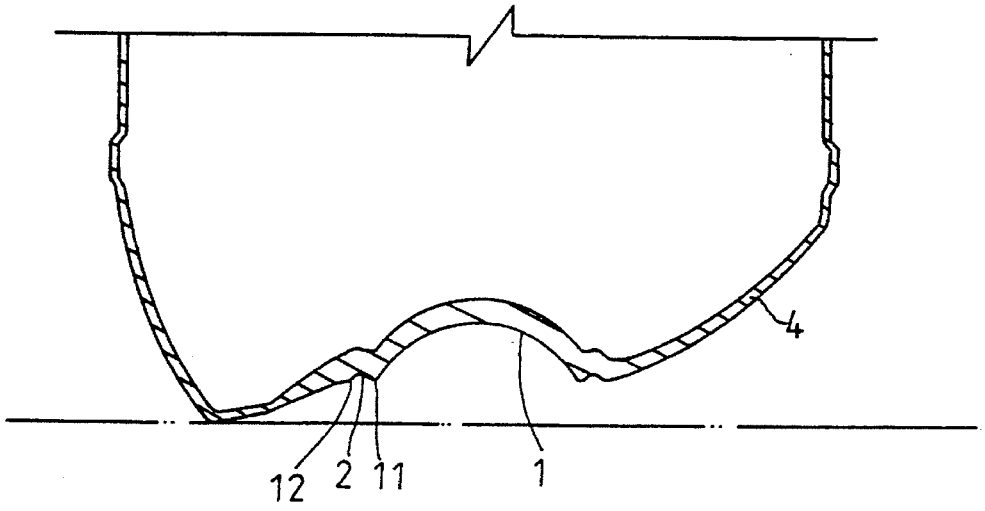
FIG. 2B is a sectional view taken along Section Line 2B—2B of FIG. 2A.
Figure 3:
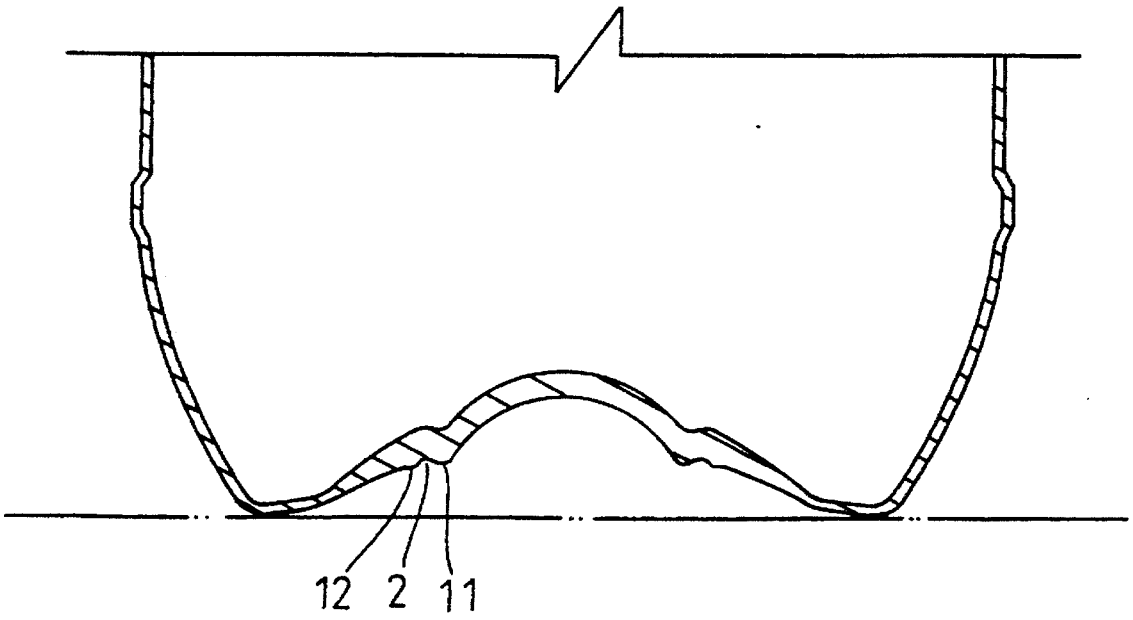
FIG. 3 is a sectional view taken along Section Line 3—3 of FIG. 2A.

As shown in FIGS. 2A, 2B and 3, the base configuration 200 is provided with a generally spherical surface, the center of which being formed with a concave spherical portion 1. The concave spherical portion 1 is designed to provide greater strength and improve the thermal stability, so as to prevent the base 200 from stress cracking and increase the flexibility thereof.

The lower edge of the concave spherical portion 1 first extends upwardly and outwardly and then downwardly and outwardly thereby forming a first protruding circular member 11 on the circumferential edge of the concave spherical portion and having a closed annular groove 2 formed around the first protruding circular member 11. Further, the circumferential edge of the annular groove 2 extends upwardly and outwardly to form a second protruding circular member 12. Hence, the base configuration 200 is provided with greater strength and improved resistance to stress cracking.

Five legs extend radially outward from the second protruding circular member 12, each of which comprises an inner side 31, a lower side 32, left and right sides 33, and an outer side 34. The inner side 31 is an inclined surface extending radially and outwardly with respect to the second protruding circular member 12. The lower side 32 is an inclined surface extending radially inward to the second protruding circular member 12. The left and right sides 33 are inclined surfaces. The outer surface 34 is a curved surface extending downwardly from the body of the container 100. The left side and right side 33 of each leg 3, together, subtend an angle A of 72 degrees (shown in FIG. 2A).

Figure 4:
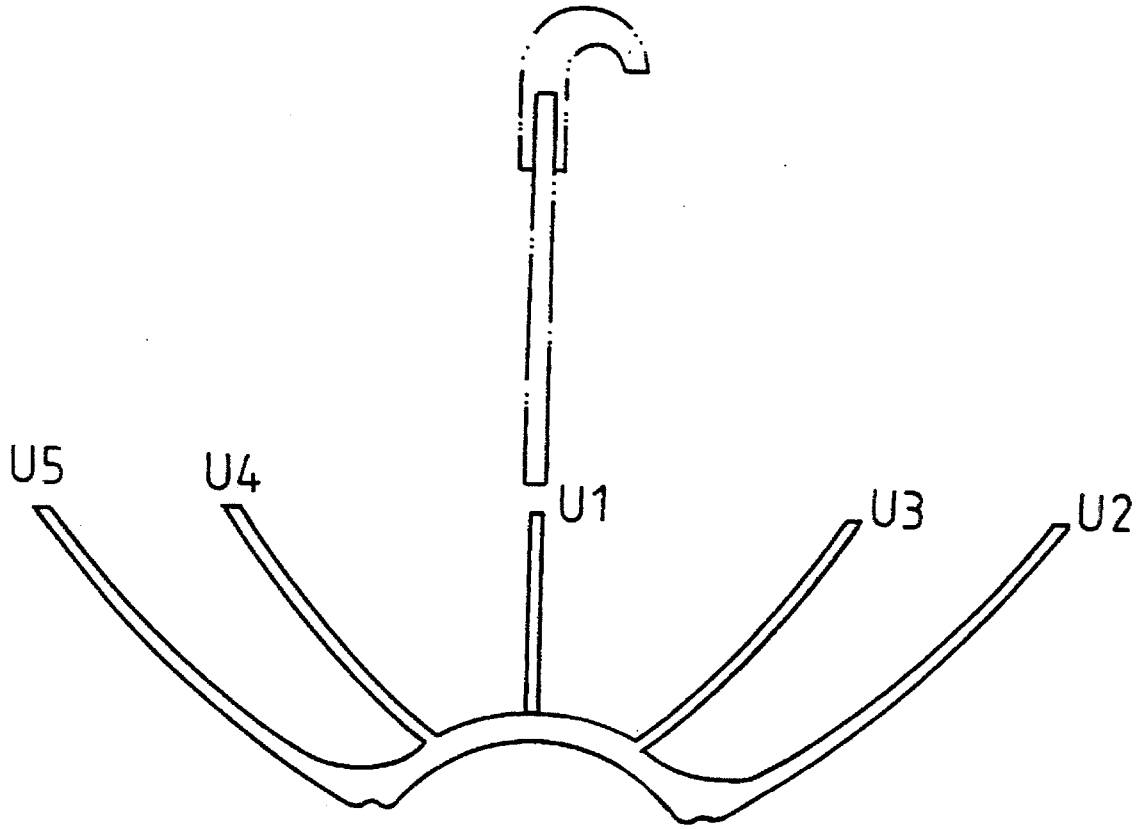
FIG. 4 illustrates the structure of the ribs.
Figure 5:
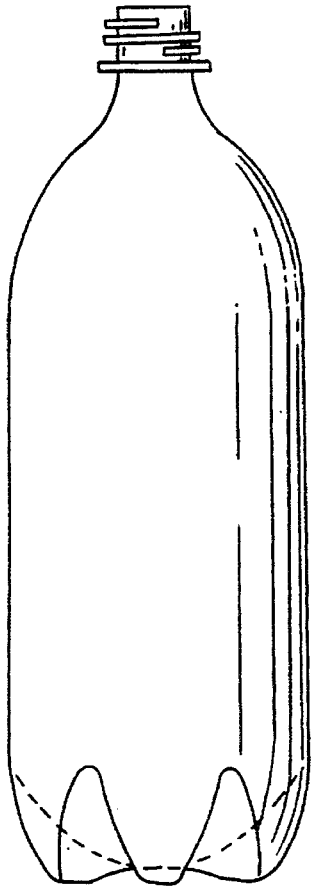
PRIOR ART FIG. 5
FIG. 5 is a front view of a prior art PET container.
Figure 6:
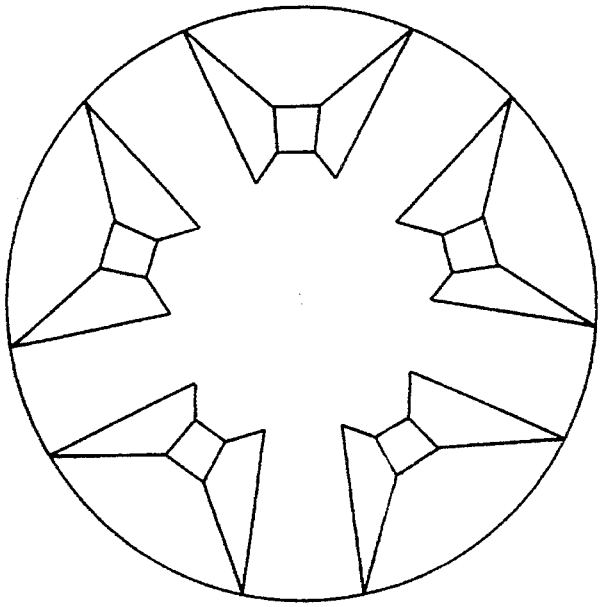
PRIOR ART FIG. 6
FIG. 6 is a bottom view of FIG. 5.
Figure 7:
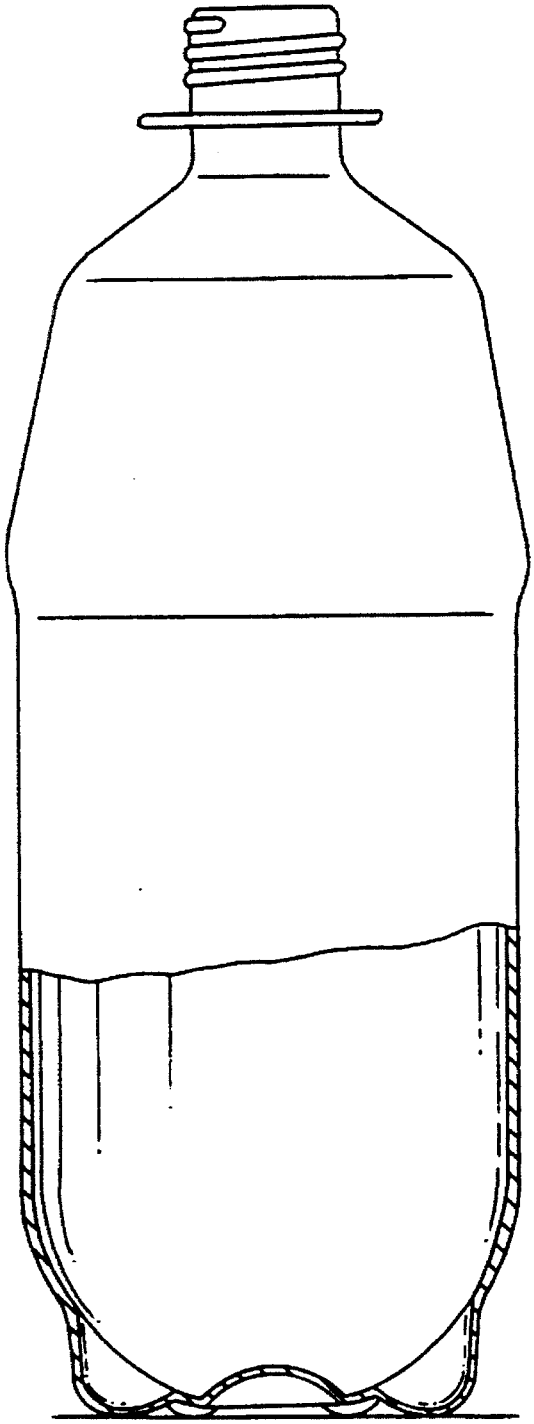
PRIOR ART FIG. 7
FIG. 7 is a front view of another prior art PET container.
Figure 8:
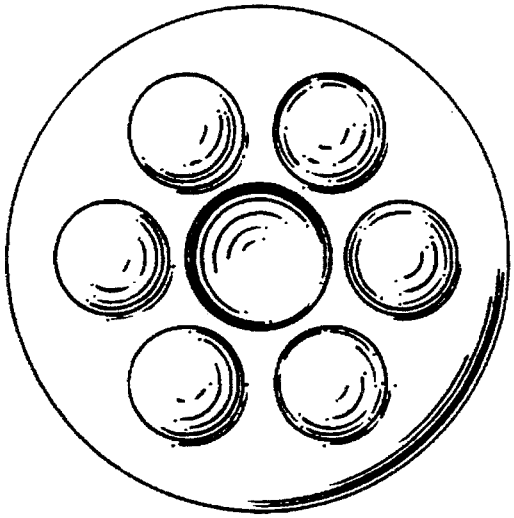
PRIOR ART FIG. 8
FIG. 8 is a bottom view of FIG. 7.

Between every two legs 3 there is a curved rib 4 which subtends an angle of 0 degrees. As shown in FIGS. 2A and 4, the curved ribs U1, U2, U3, U4 and U5 have a structure which fans out radially like the ribs of an umbrella thereby further strengthening the structure of the base configuration.

As illustrated in FIGS. 2A, 2B and 4, the base configuration 200 according to the present invention is characterized in the concave spherical portion 1, the first protruding circular member 11, the annular groove 2, the second protruding circular member 12, the ribs having a radially extending structure with each of the ribs subtending an angle of 0 degrees, and the left and right sides of each leg, together (defining the circumferential arc subtended by the outer surface 34), subtending an angle of 72 degrees. Hence, the present invention can be clearly distinguished from the prior art shown in FIGS. 5–8. Further, in numerous experiments using biaxially stretched blow molding techniques, the base configuration of the present invention possesses higher strength than those prior art configurations.

The invention is naturally not limited in any sense to the particular features specified in the foregoing or to the details of the particular embodiment which has been chosen in order to illustrate the invention. Consideration can be given to all kinds of variants of the particular embodiment which has now been described by way of example and of its constituent elements, without thereby departing from the scope of the invention. This invention accordingly includes all the means constituting technical equivalents of the means described as well as their combinations.

I claim:

1. A base configuration for a biaxially stretched blow molded PET container, comprising:

a concave spherical outer surface portion disposed centrally in said base configuration;

a first protruding circular member disposed on a circumferential edge of said concave spherical portion;

an annular groove disposed around said first protruding circular member;

a second protruding circular member disposed around said annular groove;

five legs extending radially outwardly from said second protruding circular member, each of said legs including:

(a) an outer surface having an arcuate surface contour and extending to a lower surface;

(b) an inner side surface extending radially outward and downward from said second protruding circular member to said lower surface; and (c) a pair of inclined left and right sides, each of said sides extending radially from said second protruding annular member to said outer surface and downward to said lower surface; and five radially extending curved ribs, each of said five curved ribs being formed between a respective pair of each of said five legs, each of said curved ribs being formed at an intersection of a respective inclined left and right side of a respective pair of adjacent legs, each of said curved ribs extending from said second protruding circular member to an intersection of said outer surface of each of said respective pair of legs.

2. The base configuration as recited in claim 1, wherein said lower surface is inclined upwardly toward said second protruding circular member.

3. The base configuration as recited in claim 1, where said outer surface has an angular extent approximating 72 degrees between adjacent pairs of said curved ribs.

* * * * *